United States Patent [19]

Durant

[11] Patent Number: 4,736,874

[45] Date of Patent: Apr. 12, 1988

[54] APPARATUS FOR USE ON OPEN-MOUTH CANS FOR POURING LIQUID THEREFROM

[76] Inventor: Will G. Durant, 148 N."C" St., Tustin, Calif. 92680

[21] Appl. No.: 934,284

[22] Filed: Nov. 24, 1986

[51] Int. Cl.[4] ..... B65D 25/48

[52] U.S. Cl. ..... 222/570; 220/90; 222/189; 222/567

[58] Field of Search ..... 222/566-571, 222/573, 574, 189; 220/90, 85 SP, 354, 72, 74, 320; 229/43

[56] References Cited

U.S. PATENT DOCUMENTS

| | | | |
|---|---|---|---|
| 2,688,418 | 9/1954 | Carter | 222/567 X |
| 2,837,256 | 6/1958 | Daner | 222/568 |
| 2,842,286 | 7/1958 | Beyer | 220/90 |
| 3,102,667 | 9/1963 | Ullevig | 222/570 X |
| 3,211,195 | 10/1965 | Porter | 220/85 SP |
| 3,326,409 | 6/1967 | Speer | 220/90 |
| 3,428,213 | 2/1969 | Stephens | 220/90 |
| 3,656,668 | 4/1972 | Liebertz | 222/570 |
| 4,020,968 | 5/1977 | Chiavola et al. | 222/570 X |

*Primary Examiner*—F. J. Bartuska
*Assistant Examiner*—Kevin P. Shaver
*Attorney, Agent, or Firm*—Leonard Tachner

[57] ABSTRACT

A pouring apparatus for use on a liquid-carrying container such as a paint can for preventing inadvertent spillage onto the can, the apparatus having a wedge-shaped annulus for insertion into the open mouth of the can and for frictional engagement with the inner rim of the can without being supported on the top or side wall of the can. A spout member provides a pouring surface which may be either integral to or separate from but supported by the annulus. Where the pouring surface is separate, it may be made of a disposable material such as paper. Such disposable material pouring surface or spout member is preferably secured between the wedge-shaped annulus and the inner rim of the can. This is facilitated by shaping the secured portion of the spout member to conform to the wedge shape of the annulus. By using a relatively rigid wedge to trap the paper spout member against the inner rim of the can and to wrap the spout member around the inserted portion of the wedge, the spout member can be made economically disposable while the annulus remains clean and readily reuseable. A flange portion of the annulus overlaps the top of the paint can outside of the inner rim to assure that no paint is likely to reach the can.

8 Claims, 3 Drawing Sheets

APPARATUS FOR USE ON OPEN-MOUTH CANS FOR POURING LIQUID THEREFROM

BACKGROUND OF THE INVENTION

1. Field of the Invention

The present invention relates generally to apparatus designed for insertion into the open mouth of a can such as a paint can for increasing the convenience and cleanliness of pouring a liquid such as paint from such a can or for inserting a brush or other apparatus into the can and more specifically, to a pouring apparatus at least a portion of which is designed to be disposable and which may be readily inserted into the open mouth of a can and affixed thereto without relying upon any portion of the can or can rim other than the annular open mouth of the can to support the apparatus.

2. Prior Art

The spate of prior art patents relevant to the present invention makes it quite evident that the problems associated with pouring a liquid such as paint from an open mouth can have been long recognized. More specifically, it has been the bain of virtually anyone who has attempted to pour paint from a paint can to find it unavoidable to have some paint enter the rim or groove of the can adjacent the open mouth and in some cases, leak over the edge and onto the side of the can. Such a problem makes it difficult if not impossible to resecure the can lid to the paint can after painting has been completed and the remaining paint is to be saved. Furthermore, the mess associated with having paint along the edge of the top of the can and the side of the can and possibly pouring onto the floor beneath the can, is highly undesirable. The aforementioned problem occurs even when the paint can is not tipped to pour the paint but is retained in a horizontal position while a brush is dipped into the paint can because it is extremely difficult to prevent paint from dripping off the brush as it is removed from the can to create the same mess that would have occurred had the paint been poured out of the can. Thus, over a period of many decades numerous attempts have been made to provide an apparatus adapted for connection to the top of the paint can which overcomes the aforementioned difficulties. Unfortunately, none of these prior art attempts has proved successful either because the design of such prior art devices does not entirely solve the aforementioned problems or because the devices were in such a complex configuration that they were not commercially feasible.

The following list of prior art exemplifies all of the prior attempts at solving these problems that have for one reason or another proved to be unsatisfactory.

U.S. Pat. No. 2,331,971 Gramp
U.S. Pat. No. 2,471,189 Bartels
U.S. Pat. No. 2,594,858 Bowman
U.S. Pat. No. 2,627,367 Bork
U.S. Pat. No. 2,636,650 Marrier
U.S. Pat. No. 2,720,346 Compton
U.S. Pat. No. 2,765,966 Davis
U.S. Pat. No. 2,817,464 Schugeld
U.S. Pat. No. 2,837,256 Daner
U.S. Pat. No. 2,873,052 Atherton
U.S. Pat. No. 2,960,257 Sasse
U.S. Pat. No. 3,031,112 Smith
U.S. Pat. No. 3,102,667 Ullevig
U.S. Pat. No. 3,400,867 Giannone
U.S. Pat. No. 3,750,722 Nowak U.S. Pat. No. 3,844,457 Smart
U.S. Pat. No. 3,853,249 Weir, Jr. et al
U.S. Pat. No. 3,972,453 Kapples
U.S. Pat. No. 4,034,901 Kirk
U.S. Pat. No. 4,203,537 McAlister
U.S. Pat. No. 4,225,064 Westcott
U.S. Pat. No. 4,240,568 Pool U.S. Pat. No. 2,331,971 to Gramp is directed to a detachable pour spout which utilizes a wire in combination with the pouring lip. The reinforcing wire is inserted into the annular rim portion of the paint can. The pouring lip may be formed of some type of heavy weight paper or light card stock.

U.S. Pat. No. 2,471,189 to Bartels is directed to a strainer/spout attachment for cans. An arcuate member is formed to frictionally engage in supported relation in an annular trough. The trough forms an annular channel and the overall system is inserted therein.

U.S. Pat. No. 2,594,858 to Bowman is directed to a detachable pouring spout and includes a resilient retainer wire. The retainer is inserted in a paper blank which forms a spout unit which is then grasped by a handle section and compressed until it is received within the rim section of the paint can.

U.S. Pat. No. 2,720,346 to Compton is directed to a spout/brush scraper accessory for paint cans. This includes a pouring spout where the circular edge of the spout member is rolled into a bead which is frictionally fit with the sidewalls.

U.S. Pat. No. 2,837,256 to Daner is the most relevant prior art in that it discloses the use of a wedge-like shape to threadably engage the paint can opening rim. The lower portion of an annular wall is tapered. A collar which engages the can rim is also disclosed.

U.S. Pat. No. 2,873,052 is directed to a paint can attachment and provides for a circular-type system having a ledge and an edge which serves as both a paint rest and a paint removal system.

U.S. Pat. No. 3,102,667 is directed to a pouring spout which interfaces with the rim of a paint can.

U.S. Pat. No. 3,972,453 is directed to a combined closure and pouring device and is particularly useful for closure devices which may be paint cans. This system appears to be rim engaging where the closure portion is normally circular in shape and passes over the rim edges.

U.S. Pat. No. 4,034,901 is a dripless spout for paint cans. There is a mating engagement between a circular bead and a circular groove of the paint can.

All of the prior art noted above may be characterized as failing to provide a commercially satisfactory solution to the aforementioned problems either because of the complexity and attendant expense of the attempted solution or because the solution proposed by the prior art proved inadequate. One typical example of the complexity of the prior art seen in a number of the aforementioned prior art patents is the attempt to utilize the top exterior rim of the can adjacent the open mouth as a means for supporting all or a portion of the elements comprising the prior art devices.

SUMMARY OF THE INVENTION

There has therefore been a long-felt need for a pouring apparatus of the type adapted to be interfaced with an open mouth can such as a paint can which preserves the clean condition of the can during use even when the can is tilted to pour the contents thereof out of the can or when a brush or other instrument is inserted into the can to mix, stir or extract a quantity of the liquid contained therein. The aforementioned long-felt need extends to a device which provides the aforementioned capability in a relatively simple configuration which is of sufficiently low cost to make it commercially viable and even sufficiently low in cost to make part or all of the device discardable.

The present invention provides an elegant but simple solution to the aforementioned long-felt need by providing a pouring apparatus in the form of a collar insert and a spout member. These two elements of the invention may be either separate or integral depending upon the embodiment selected. The collar insert is provided with a wedge portion which is designed to be supported within the open mouth of the can without any additional support whatsoever that might otherwise rely upon other portions of the structure of the can such as the top of the can or the side of the can or the exterior lip adjacent the open mouth of the can. At least the exterior periphery of the wedge portion of the collar insert is provided with a taper of a selected angle (4 degrees in a preferred embodiment), whereby the frictional engagement between the wedge-shaped portion of the collar insert and the interior surface of the open mouth rim of the can increases as the wedge portion is compressed further into the can opening.

The present invention also provides a spout member which may be integral to the collar insert or as in a preferred embodiment of the invention, may be a separate disposable member made out of a relatively inexpensive material such as paper or plastic. The spout member may, as the name implies, be shaped in the form of a spout to increase the convenience of pouring the contents of the can using the apparatus of the present invention. However, the specific shape of the spout member is not to be limiting of the present invention since it may in fact be virtually any shape such as cylindrical or conical. These shapes for example may be preferred for applications in which the contents of the can are not poured but instead a brush or other instrument is inserted into the can for extracting a portion of the contents thereof. The spout member may also be in the form of or include a liquid transmissive material such filter paper or metallic strainer material to provide a means for filtering solid pieces of the contents within the can so that when the contents are poured out of the can using the present invention, such a straining or filtering material assures that only liquid exits the can. This feature is particularly advantageous for paint and paint cans where it is especially undesirable to inadvertently pour out pieces of solid material within the paint that would otherwise detrimentally affect the surface appearance of the applied paint. A particularly advantageous feature of the spout member is its action as a 360 degree gasket seal between the inner rim of the can and the wedge portion of the collar insert.

Still another configuration for the spout member of the present invention is that of an enclosed cap of virtually any height which may be used to enclose the contents of the can without requiring removal of the invention and replacement of the original can top. The collar insert of the present invention may be configured in such a way as to in effect, make the spout member integral thereto and thereby avoid the need for a separate element to provide the spout portion thereof. In each of the several embodiments of the invention disclosed therein the particularly advantageous feature which is deemed to be the principal basis for patentability hereof is the collar insert having a full circle wedge portion which is designed to be inserted into the open mouth of the top of the and can be frictionally engaged therewith without resting upon any other portion of the can or in any other way relying on an interface with another portion of the can for achieving a leak-proof relationship therewith as attempted by the prior art.

OBJECTS OF THE INVENTION

It is therefore a principal object of the present invention to provide a pouring apparatus adapted for partial insertion into the open mouth of a can such as a paint can for providing access to the contents of the can with little or no chance of inadvertently spilling the contents onto the can.

It is an additional object of the present invention to provide a pouring apparatus adapted for interconnection to an open mouth can such as a paint can for increasing the convenience of pouring the contents out of the can and which apparatus is relatively simple, low cost and discardable.

It is still an additional object of the present invention to provide a pouring apparatus particularly suitable for use in paint cans and adapted to permit pouring of the paint out of the can with little or no chance of inadvertently allowing any of the paint to reach the top or sides of the can, the apparatus comprising a circular collar insert and a spout member, the spout member being preferably of the type which is separable from the collar insert and which is discardable and the collar insert having a wedge portion which is adapted to frictionally engage the interior rim of the open mouth of the can without otherwise engaging any other external portion of the can.

BRIEF DESCRIPTION OF THE DRAWINGS

The aforementioned objects and advantages of the present invention as well as additional objects and advantages thereof will become apparent hereinafter as a result of a detailed description of preferred embodiments when taken in conjunction with the following drawings in which.

DESCRIPTION OF PREFERRED EMBODIMENTS

Figure 1:
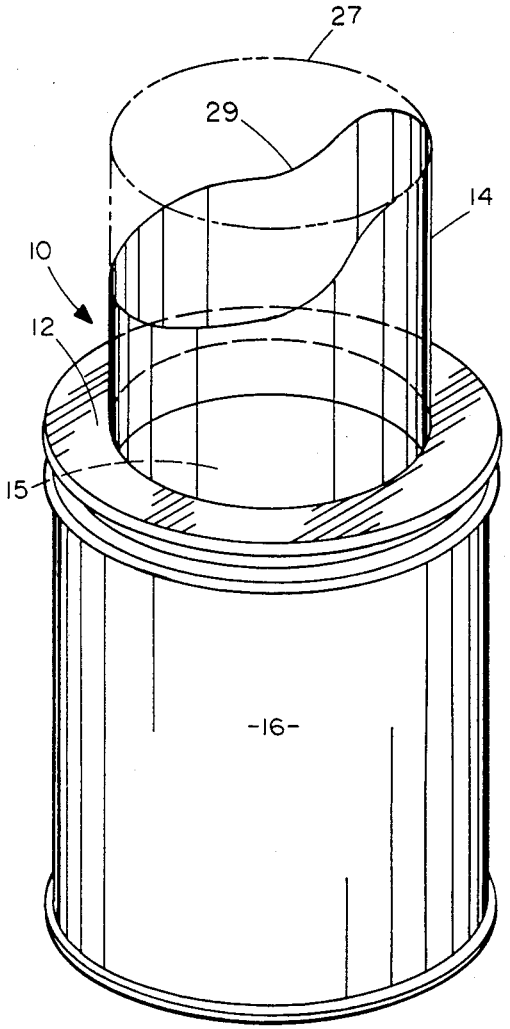
FIG. 1 is a three dimensional illustration of one embodiment of the present invention shown in engagement with a can and ready for use therewith.
Figure 2:
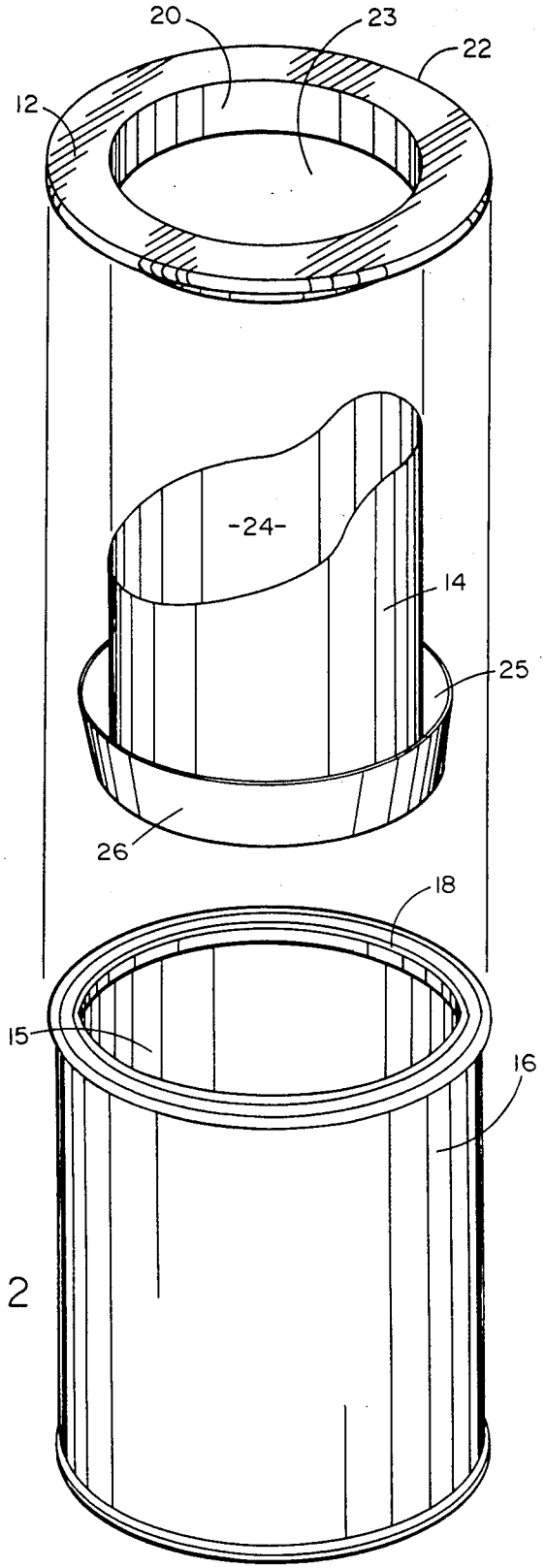
FIG. 2 is an exploded view of the embodiment of the invention illustrated in FIG. 1.

Referring first to FIGS. 1 and 2 it will be seen that the pouring apparatus 10 of the present invention comprises a collar insert 12 and a spout member 14. The apparatus 10 is designed to be inserted into the open mouth 15 of a can 16 such as a paint can. The apparatus is engaged with the open mouth of the can by frictional engagement with the inner rim 18 of the can 16 as will be hereinafter more fully explained. Collar insert 12 comprises a ring-shaped configuration having a wedge portion 20 and a flange portion 22, the wedge portion being designed to frictionally engage the inner rim 18 and the flange portion being designed to extend horizontally over the top of can 16 in spaced parallel relationship therewith such as shown in FIG. 1. The wedge portion is preferably of a suitable dimension to fit most manufacturer's variations of standard size cams such as either quart or gallon size paint cans.

The spout member 14 in one preferred embodiment of the invention illustrated in FIGS. 1 and 2 comprises an upper portion 24 and a lower portion 26. The upper portion 24 may be of any desired shape. By way of example, the upper-most edge of upper portion 24 may take on the generally cylindrical configuration represented by edge 27 of FIG. 1 or it may take on the spout configuration represented by edge 29 of FIG. 1. These, of course, are only two examples of the upper-most edge shape of spout member 14, the actual shape being determined by the preferred use of the pouring apparatus 10. Thus for example, the spout configuration represented by edge 29 would be most suitable for pouring the contents of the can 16 by tilting same in conjunction with the pouring apparatus while the cylindrical configuration represented by edge 27 of FIG. 1 would be more suitable for insertion of a brush or other apparatus into the can with the pouring apparatus 10 attached thereto.

In the preferred embodiment disclosed herein the lower portion 26 of the spout member 14 is folded back on itself to form a wedge-shaped pocket 25 adpated to receive the wedge portion 20 of the collar insert 12 and the upper portion 24 is designed to extend through an interior passage 23 of the collar insert 12 defined by the wedge portion 20. In this manner the frictional engagement between the wedge portion of collar insert 12 and the inner rim 18 of the can 16, effectively secures spout member 14 between the collar insert and the can while permitting removal and replacement of the spout member 14 after each use as desired by the user. Furthermore, the lower portion 26 of the spout member provides a 360 degree gasket seal between the wedge portion 20 and the inner rim 18. The used spout member 14 may be readily discarded because of its inexpensive configuration and because it is preferably made out of a relatively inexpensive material such as a form of paper stock or thin flexible plastic.

Figure 3:
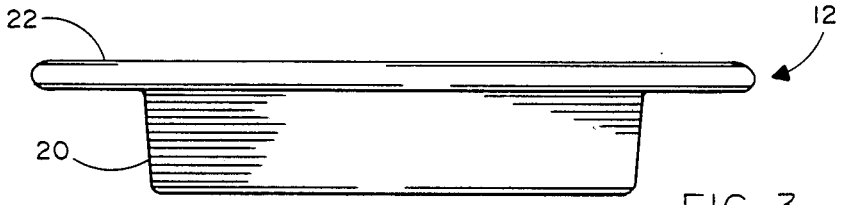
FIG. 3 and 4 are plan and cross-sectional views, respectively, of the first embodiment of the invention.
Figure 4:
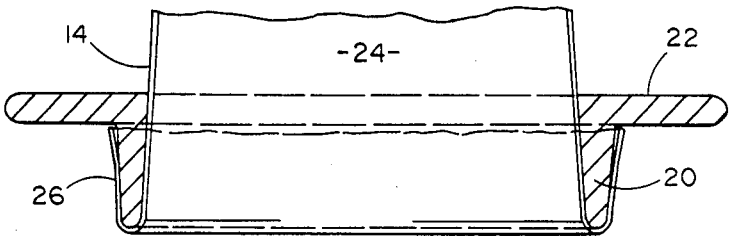
Figure 5:
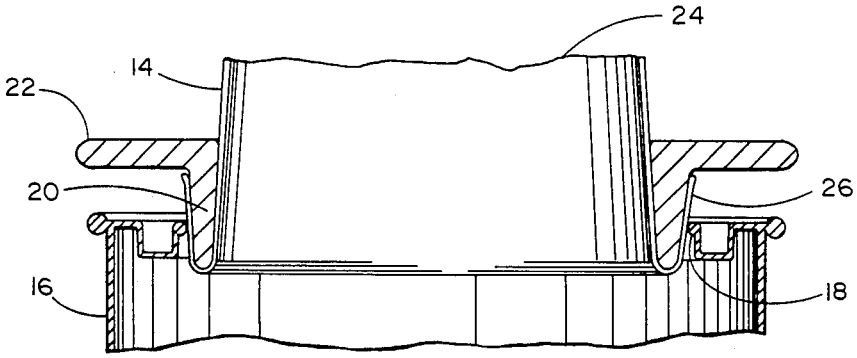
FIG. 5 is a cross-sectional view of the first embodiment of the invention shown in its position engaging the open mouth of a can.

The details of the interface between the collar insert 12, spout member 14 and can 16 may be better understood by reference to FIGS. 3, 4 and 5. As shown in FIGS. 3, 4 and 5, the lower portion 26 of spout member 14 is bent or otherwise configured to conform to the wedge shape of wedge portion 20 of collar insert 12. Accordingly, the outer periphery of lower portion 26 of the spout member is positioned between the wedge portion 20 of the collar insert and the rim 18 of the can 16 when the first embodiment of the pouring apparatus 10 of the present invention is inserted into the open mouth 15 of the can. Thus, insertion and removal of the spout member 14 from the collar insert 12 is readily effected with the pouring apparatus 10 removed from the can by simply moving the spout member 14 vertically relative to the collar insert 12 to cause engagement and disengagement, respectively between the lower portion 26 of the spout member and the wedge portion 20 of the collar insert as made readily apparent by FIGS. 3, 4 and 5.

Figure 6:
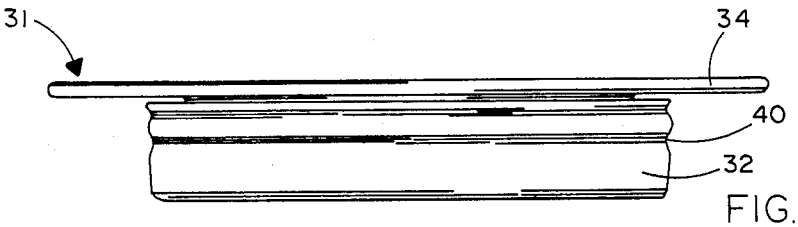
FIGS. 6 and 7 are plan and cross-sectional views, respectively, of a second embodiment of the invention.
Figure 7:
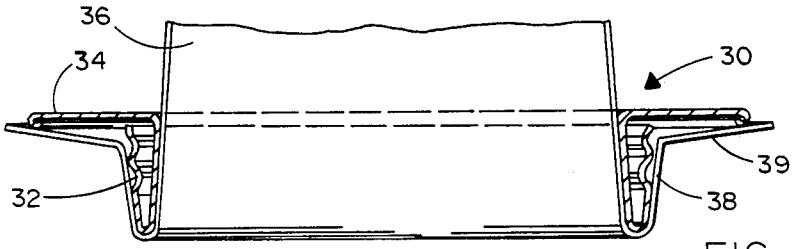
Figure 8:
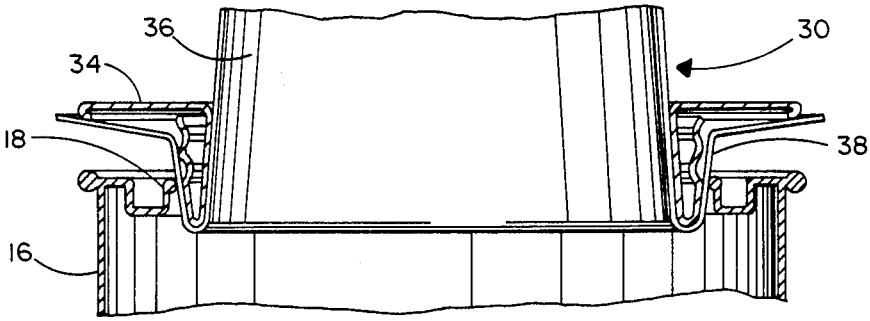
FIG. 8 is a partially cross-sectional view the second embodiment of the invention shown in its position engaging the open mouth of the can.

A second embodiment 30 of the present invention is illustrated in FIGS. 6, 7 and 8. This second embodiment utilizes a folded, thin collar insert configuration in place of the solid configuration of the first embodiment 10. Thus, in this second embodiment configuration of FIGS. 6, 7 and 8, the wedge portion 32 and flange portion 36 of the alternatively configured collar insert 31 may be formed of a folded or stamped thin material such as sheet metal or plastic rendering it even less costly and lighter than the configuration of the first embodiment. In addition, the spout member 36 is provided with a lower portion 38 which includes a flared peripheral member 39 extending laterally from the exterior periphery of the lower portion 38 to provide additional protection from inadvertent spillage of the contents of the can 16 onto the top of the can to further the cleanliness feature of the present invention. One additional optional feature of the second embodiment 30 of the invention shown in FIGS. 6, 7 and 8, is a wavey or serrated outer periphery 40 of the lower portion 38 of collar insert 31 to enhance the frictional engagement between the collar insert and the can rim 18.

Figure 9:
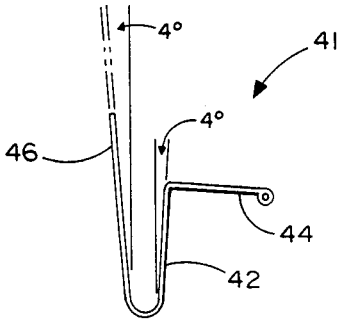
FIG. 9 is an enlarged cross-sectional view of a portion of a third embodiment of the present invention.

Still another embodiment of the invention is illustrated in FIG. 9. This third embodiment 41 of FIG. 9 illustrates a number of alternative design configurations which may be employed in the present invention. More specifically, in the embodiment 41 of the invention illustrated therein, the flange portion 44 is made integral to the outer periphery of the wedge portion 42 as opposed to being integral to the inner peripheral portion thereof as previously described for the second embodiment of FIGS. 6, 7 and 8. This alternative interface between the flange portion and wedge portion is particularly desirable when it is preferred to have the spout member 46 be integral with the collar insert thereby obviating the use of a separate disposable spout member such as shown in the first and second embodiments of the invention previously described. However, it will be understood that the third embodiment 41 of the present invention may alternatively be used with a separate spout member in the same manner described previously. In any case, FIG. 9 illustrates the preferred wedge angle that may be advantageously used in all of the embodiments of the present invention, namely, an angle of 4 degrees relative to the vertical for both the inner and outer peripheral surfaces of the wedge portion. Although it will be readily apparent that other angles for the wedge portion for the collar insert may be utilized in the present invention, the applicant has found by experimentation in his reduction to practice that the 4 degree angle illustrated in FIG. 9 appears to provide frictional engagement between the invention and the can assuring a secure interface between the invention and the can while still allowing relatively easy removal of the invention from the can without requiring the use of an inappropriately large force. However, it will be understood that the wedge-shaped portion of the present invention is not necessarily limited to the use of the 4 degree angles illustrated in FIG. 9 and that the invention may be satisfactorily configured to have wedge angles that are either less than or greater than the 4 degrees.

It will now be understood that what has been disclosed herein is a unique pouring apparatus that is adapted for insertion into the open mouth of a can such as a paint can for providing a simple expedient and convenient means for pouring the contents of the can or permitting access to the contents of the can while substantially assuring that the contents of the can will not be inadvertently poured onto the exterior surface of the can. Several different embodiments of the invention have been disclosed including one embodiment in which the pouring apparatus comprises a collar insert and a spout member. The spout member may be a discardable material such as paper stock or plastic. The collar insert has a wedge portion adapted to frictionally engage the inner rim of the open mouth of the can for securing the invention thereto. Alternative configurations of the collar insert and spout member have been disclosed herein including one configuration in which those two members of the invention are made integral thereby forming a unitary apparatus. A key feature of the present invention is that the apparatus is supported entirely by the frictional engagement with the inner rim of the open mouth of the can and does not rely in any way upon support derived from any other portion of the can such as the top rim or exterior side surface thereby substantially simplifying the invention as compared to the prior art, reducing its cost and enhancing its convenience of use.

Those having skill in the art to which the present invention pertains will now, as a result of the teachings herein, perceive various modifications and additions. By way of example, other collar insert and spout member configurations will now occur to those who have had the benefit of the disclosure herein, however, all such modifications and additions are deemed to be within the scope of the invention which is to be limited only by the claims appended hereto.

I claim:

1. An apparatus for use in combination with a liquid carrying container, which container includes an annular rim proximate the top of an upright continuous sidewall, the rim having an inner peripheral surface defining the mouth of the container, the apparatus comprising:

a ring-shaped insert having a wedge portion, the wedge portion having an annular tapered peripheral surface for bearing against the inner peripheral surface of said rim; and a spout member defining a pouring surface on which said liquid may flow through said apparatus, a portion of said spout member being substantially contiguous to said tapered peripheral surface of said wedge portion such that said spout member is retained between the tapered peripheral surface of said wedge portion and said rim; said contiguous portion of said spout member being folded about said wedge portion of said insert for preventing said liquid from contacting said insert.

2. The apparatus defined in claim 1 wherein said spout member is readily removed and replaced when said ring-shafted insert is separated from said container.

3. The apparatus recited in claim 1 wherein said contiguous portion of said spout member and said annular peripheral surface of said wedge portion are equally angled to alter the extent of engagement with said rim upon insertion of said attachment into said mouth.

4. The apparatus recited in claim 1 wherein said annular peripheral surface of said wedge portion is serrated to enhance the engagement with said rim.

5. The apparatus recited in claim 1 wherein said insert also comprises a flange portion extending transverse to said wedge portion for overlying said rim in spaced relation therewith.

6. The apparatus recited in claim 1 wherein said spout member comprises a liquid filtering material for preventing solid pieces in said liquid from being inadvertently extracted from said container.

7. The apparatus recited in claim 1 wherein said spout member is made of a non-rigid material and said insert is made of a rigid material.

8. The apparatus recited in claim 7 wherein said non-rigid material is paper.

* * * * *